US011417990B2

(12) United States Patent
Matsuura

(10) Patent No.: US 11,417,990 B2
(45) Date of Patent: Aug. 16, 2022

(54) CONNECTOR THAT INCLUDES ASSEMBLY DETECTING PORTION

(71) Applicant: SUMITOMO WIRING SYSTEMS, LTD., Mie (JP)

(72) Inventor: Junya Matsuura, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/979,554

(22) PCT Filed: Feb. 27, 2019

(86) PCT No.: PCT/JP2019/007410
§ 371 (c)(1),
(2) Date: Sep. 10, 2020

(87) PCT Pub. No.: WO2019/181393
PCT Pub. Date: Sep. 26, 2019

(65) Prior Publication Data

US 2021/0006014 A1 Jan. 7, 2021

(30) Foreign Application Priority Data

Mar. 20, 2018 (JP) ..... JP2018-051896

(51) Int. Cl.
*H01R 3/00* (2006.01)
*H01R 13/639* (2006.01)
*H01R 13/64* (2006.01)

(52) U.S. Cl.
CPC ..... *H01R 13/639* (2013.01); *H01R 13/64* (2013.01)

(58) Field of Classification Search
CPC ..... H01R 2103/00; H01R 13/6272; H01R 13/465; H01R 13/641; H01R 13/4223;
(Continued)

(56) References Cited

U.S. PATENT DOCUMENTS 5,562,486 A * 10/1996 Saijo ..... H01R 13/4362 439/188
5,618,201 A * 4/1997 Yagi ..... H01R 13/641 439/489

(Continued)

OTHER PUBLICATIONS

International Search Report dated Jun. 4, 2019 for WO 2019/181393 A1 (2 pages).

*Primary Examiner* — Thanh Tam T Le
(74) *Attorney, Agent, or Firm* — Venjuris, P.C.

(57) ABSTRACT

It is aimed to detect whether or not a shorting terminal fitting is properly mounted. A female connector (F) is provided with a terminal mounting portion (21) formed in a female housing (20), a shorting terminal fitting (30) mounted in the terminal mounting portion (21), a lock arm (24) formed in the female housing (20) and resiliently displaceable toward the terminal mounting portion (21) due to interference with a male housing (10) in an incompletely connected state, and assembly detecting portions (29) for detecting an improperly assembled state of the shorting terminal fitting (30) by interfering with the shorting terminal fitting (30) in a connection process of the female housing (29) and the male housing (10) when the shorting terminal fitting (30) is improperly mounted in the terminal mounting portion (21).

3 Claims, 9 Drawing Sheets

(58) Field of Classification Search
CPC ... H01R 13/2442; H01R 13/64; H01R 13/639
USPC ..... 439/188, 352, 595, 488, 489, 862
See application file for complete search history.

(56) References Cited

U.S. PATENT DOCUMENTS

| | | | | | |
|---|---|---|---|---|---|
| 5,628,649 | A * | 5/1997 | Yagi | H01R 13/6272 | 439/354 |
| 5,743,760 | A * | 4/1998 | Inaba | H01R 13/6272 | 439/489 |
| 5,820,399 | A * | 10/1998 | Shirouzu | H01R 13/641 | 439/352 |
| 5,848,912 | A * | 12/1998 | Okabe | H01R 13/6275 | 439/489 |
| 5,863,216 | A | 1/1999 | Tsuji et al. | | |
| 6,126,496 | A * | 10/2000 | Shinozaki | H01R 13/7033 | 439/862 |
| 6,241,547 | B1 * | 6/2001 | Fukuda | H01R 13/641 | 439/352 |
| 6,827,596 | B2 * | 12/2004 | Hori | H01R 13/6275 | 439/188 |
| 7,275,946 | B2 * | 10/2007 | Ohtaka | H01R 13/7032 | 200/51.1 |
| 7,294,015 | B2 * | 11/2007 | Fujii | H01R 13/641 | 439/489 |
| 7,488,197 | B2 * | 2/2009 | Shinozaki | H01R 13/7031 | 439/489 |
| 8,764,496 | B2 | 7/2014 | Todo et al. | | |
| 8,851,921 | B2 * | 10/2014 | Segawa | H01R 13/7031 | 439/489 |
| 10,158,196 | B2 * | 12/2018 | Fujii | H01R 13/639 | |
| 10,707,620 | B2 * | 7/2020 | Imai | H01R 13/639 | |
| 2018/0115110 | A1 | 4/2018 | Fujii et al. | | |

* cited by examiner

CONNECTOR THAT INCLUDES ASSEMBLY DETECTING PORTION

CROSS REFERENCE TO RELATED APPLICATIONS

This application is a national phase of PCT application No. PCT/JP2019/007410, filed on 27 Feb. 2019, which claims priority from Japanese patent application No. 2018-051896, filed on 20 Mar. 2018, all of which are incorporated herein by reference.

TECHNICAL FIELD

The present invention relates to a connector.

BACKGROUND

Patent Document 1 discloses a connector device having a function of detecting a connected state of a female connector and a male connector. The female connector includes a female housing formed with a lock arm and a shorting terminal fitting mounted in the female housing. The male connector includes a male housing and a pair of detection terminals mounted in the male housing. With the both connectors incompletely connected, the lock arm interferes with a lock portion of the male housing to be resiliently deflected and a pair of resilient contact pieces provided on the shorting terminal fitting are pressed by the resiliently deflected lock arm, thereby being resiliently displaced to retracted positions not in contact with the pair of detection terminals. When the both connectors reach a properly connected state, the lock arm resiliently returns to lock the lock portion. As the lock arm resiliently returns, the pair of resilient contact pieces resiliently return to short the pair of detection terminals. Therefore, the connected state of the both connectors can be detected based on whether or not the pair of detection terminals are shorted via the shorting terminal fitting.

PRIOR ART DOCUMENT

Patent Document

Patent Document 1: JPH 10-041018A

SUMMARY OF THE INVENTION

Problems to be Solved

In the above connector device, if the shorting terminal fitting is mounted in an improper posture inclined with respect to the female housing, the pair of resilient contact pieces are not aligned in an approaching/separating direction of the resilient contact pieces and the detection terminals. Thus, when the both connectors are properly connected and the pair of detection terminals and the pair of resilient contact pieces resiliently contact each other, troubles such as different contact pressures of the pair of resilient contact pieces with the detection terminals occur.

The present invention was completed on the basis of the above situation and aims to detect whether or not a shorting terminal fitting is properly mounted.

Means to Solve the Problem

The present invention is directed to a connector with a connector housing connectable to a mating housing, the connector housing reaching a properly connected state by way of an incompletely connected state in a connection process, a terminal mounting portion formed in the connector housing, a shorting terminal fitting mounted in the terminal mounting portion, a lock arm formed in the connector housing, the lock arm being resiliently displaceable toward the terminal mounting portion due to interference with the mating housing in the incompletely connected state, and an assembly detecting portion formed on the lock arm, the assembly detecting portion being capable of detecting an improperly assembled state of the shorting terminal fitting by interfering with the shorting terminal fitting in the connection process of the connector housing and the mating housing when the shorting terminal fitting is mounted in an improper posture in the terminal mounting portion.

Effect of the Invention

If the shorting terminal fitting is mounted in an improper posture in the terminal mounting portion, the assembly detecting portion interferes with the shorting terminal fitting in the connection process of the mating housing and the connector housing. According to the present invention, whether or not the shorting terminal fitting is properly mounted can be detected based on whether or not the assembly detecting portion interferes with the shorting terminal fitting.

DETAILED DESCRIPTION TO EXECUTE THE INVENTION

Figure 1:
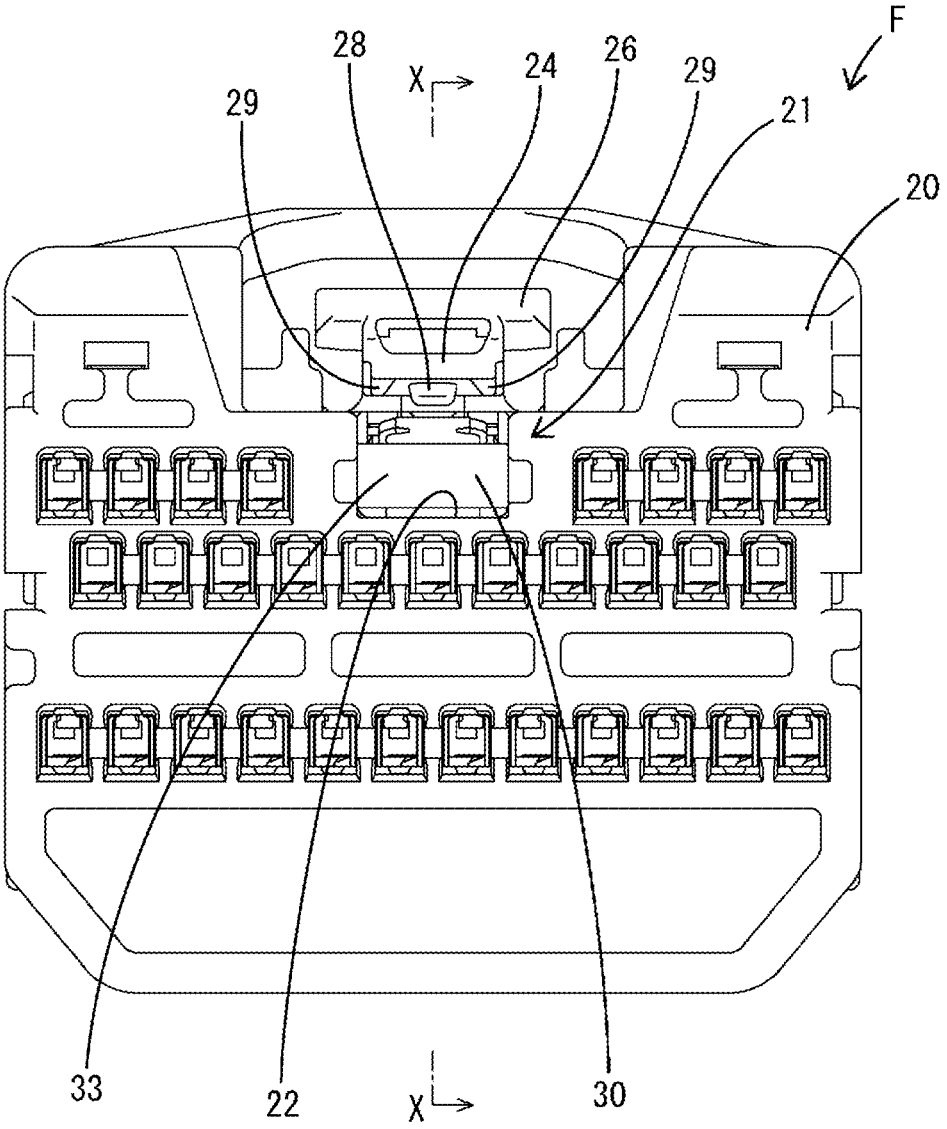
FIG. 1 is a back view showing a state where a lock arm is not resiliently deflected in a connector of one embodiment.

The present invention may be such that the shorting terminal fitting includes a shorting spring and a pair of protection wall portions disposed to face each other across the shorting spring, the assembly detecting portion is displaced along inner surfaces of the protection wall portions as the lock arm is resiliently displaced if the shorting terminal fitting is mounted in a proper posture, and a resilient displacement of the lock arm is restricted due to the interference of the assembly detecting portion with the protection wall portion if the shorting terminal fitting is improperly assembled.

According to this configuration, a space between the pair of protection wall portions, i.e. an internal space of the shorting terminal fitting, is effectively utilized as a space for displacing the assembly detecting portion when the lock arm is resiliently displaced. Therefore, the connector housing can be reduced in size as compared to the case where a displacement space for the assembly detecting portion is secured outside the shorting terminal fitting.

The present invention may be such that the shorting spring resiliently contacts a pair of detection terminals provided in the mating housing in the properly connected state, thereby shorting the pair of detection terminals, the lock arm includes a pressing portion for pressing the shorting spring to a short-circuit releasing position where the shorting spring is incapable of contacting the pair of detection terminals in the incompletely connected state and resiliently returning to a lock position to be separated from the shorting spring in the properly connected state, and the pressing portion presses a central part of the shorting spring in a facing direction of the pair of protection wall portions.

According to this configuration, since the pressing portion presses the central part of the shorting spring in the facing direction of the pair of protection wall portions, the shorting spring is not inclined when being resiliently deformed by receiving a pressing force of the pressing portion. Since there is no concern that the lock arm is inclined by a resilient reaction force of the shorting spring, it is possible to avoid erroneous detection of a connected state due to the inclination of the lock arm.

The present invention may be such that an interval between the assembly detecting portion and the shorting spring is set larger than an interval between the pressing portion and the shorting spring in a state where the lock arm is not resiliently displaced. According to this configuration, the interference of the assembly detecting portion with the shorting spring can be prevented.

The present invention may be such that the shorting terminal fitting is formed with a pair of wiping springs arranged in parallel across a clearance, the pair of detection terminals sliding in contact with the pair of wiping springs in the connection process of the mating housing and the connector housing, the pair of wiping springs being separated from the detection terminals by a flat plate-like short-circuit releasing portion formed in the mating housing in the properly connected state, and the clearance serves as an entrance path for a reinforcing rib projecting in a plate thickness direction of the short-circuit releasing portion from the short-circuit releasing portion. According to this configuration, the rigidity of the short-circuit releasing portion can be enhanced, utilizing the clearance provided between the pair of wiping springs.

Embodiment

Hereinafter, one specific embodiment of the present invention is described with reference to FIGS. 1 to 9. A connector device of this embodiment includes a female connector F (connector as claimed) and a male connector M connectable to the female connector F and has a connection detecting function of detecting a connected state of the both connectors F, M.

Figure 4:
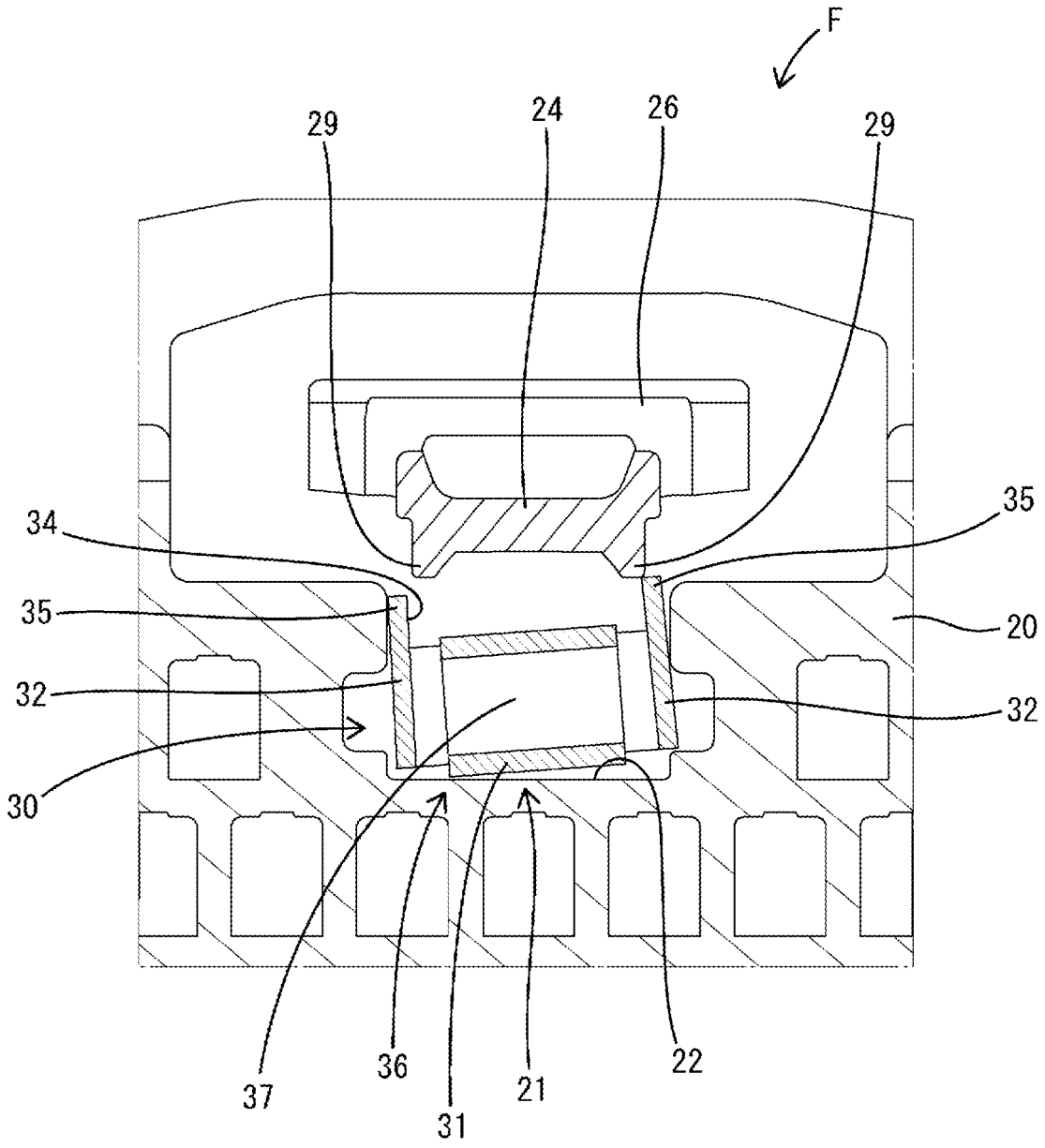
FIG. 4 is a front view in section showing a state where the inclination of a shorting terminal fitting is detected.
Figure 5:
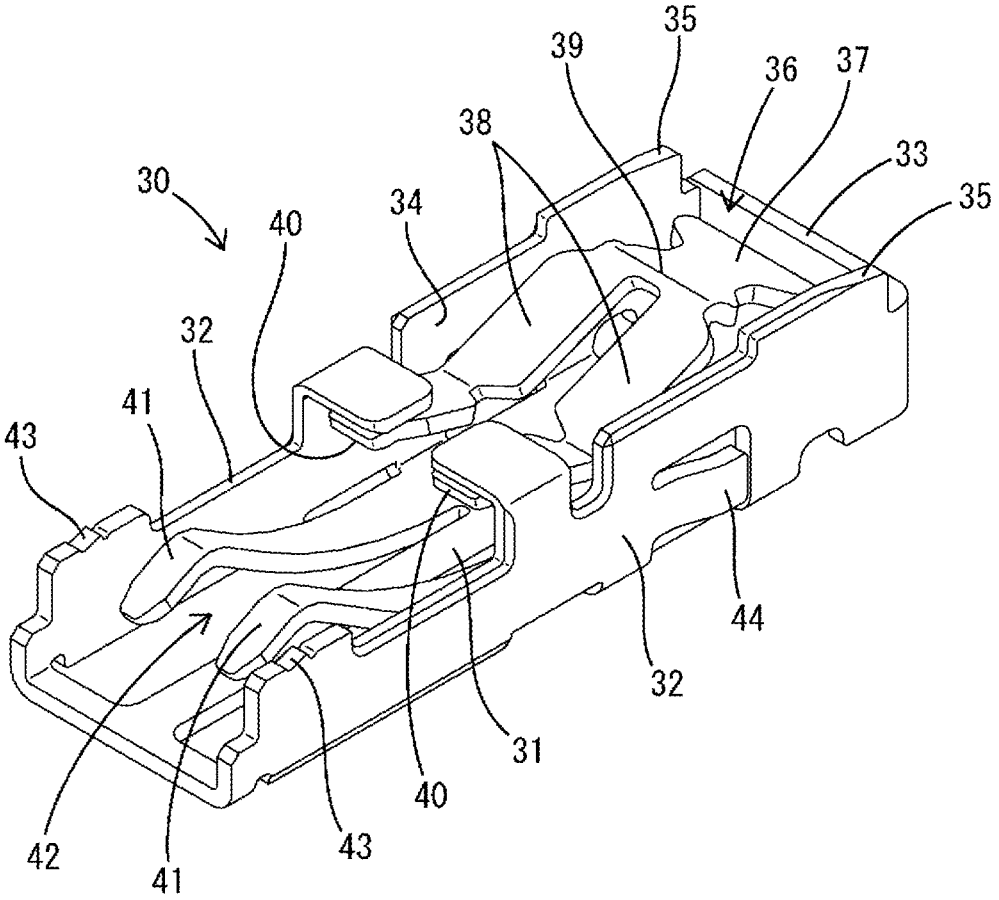
FIG. 5 is a perspective view of the shorting terminal fitting.
Figure 6:
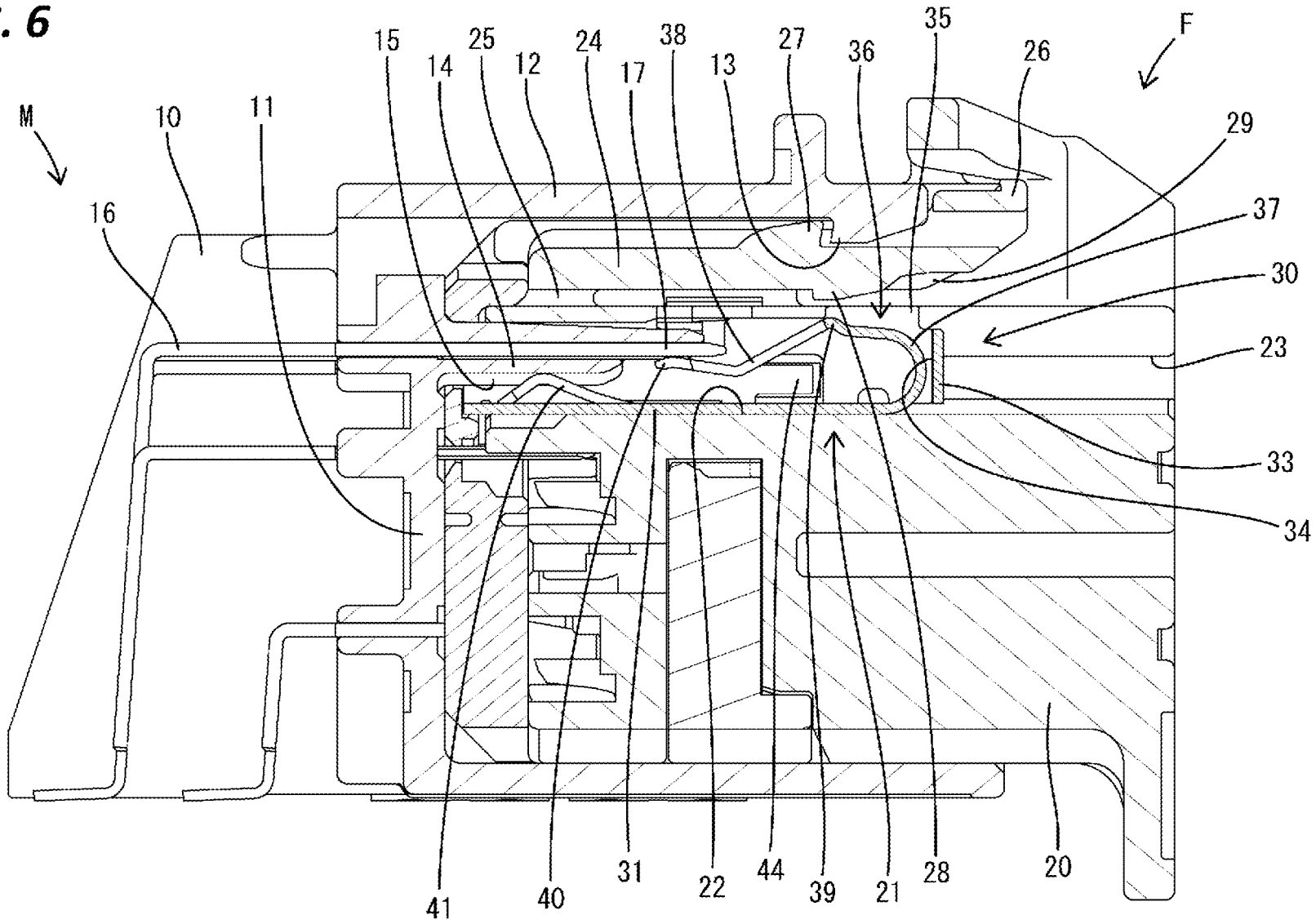
FIG. 6 is a section along X-X of FIG. 1 showing a state where the female connector and a male housing are properly connected.
Figure 7:
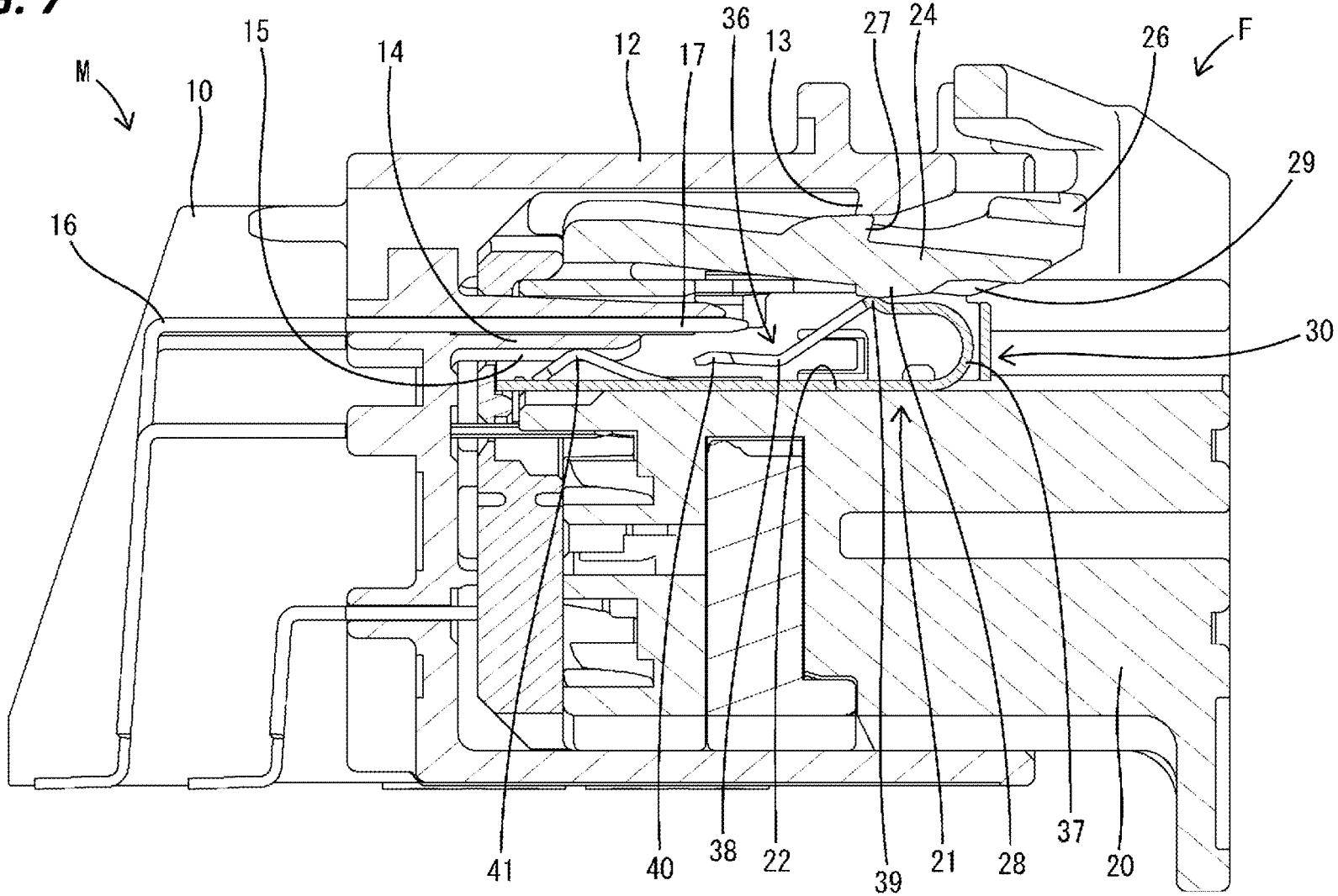
FIG. 7 is a section along X-X of FIG. 1 showing a state where the female connector and the male housing are incompletely connected.
Figure 8:
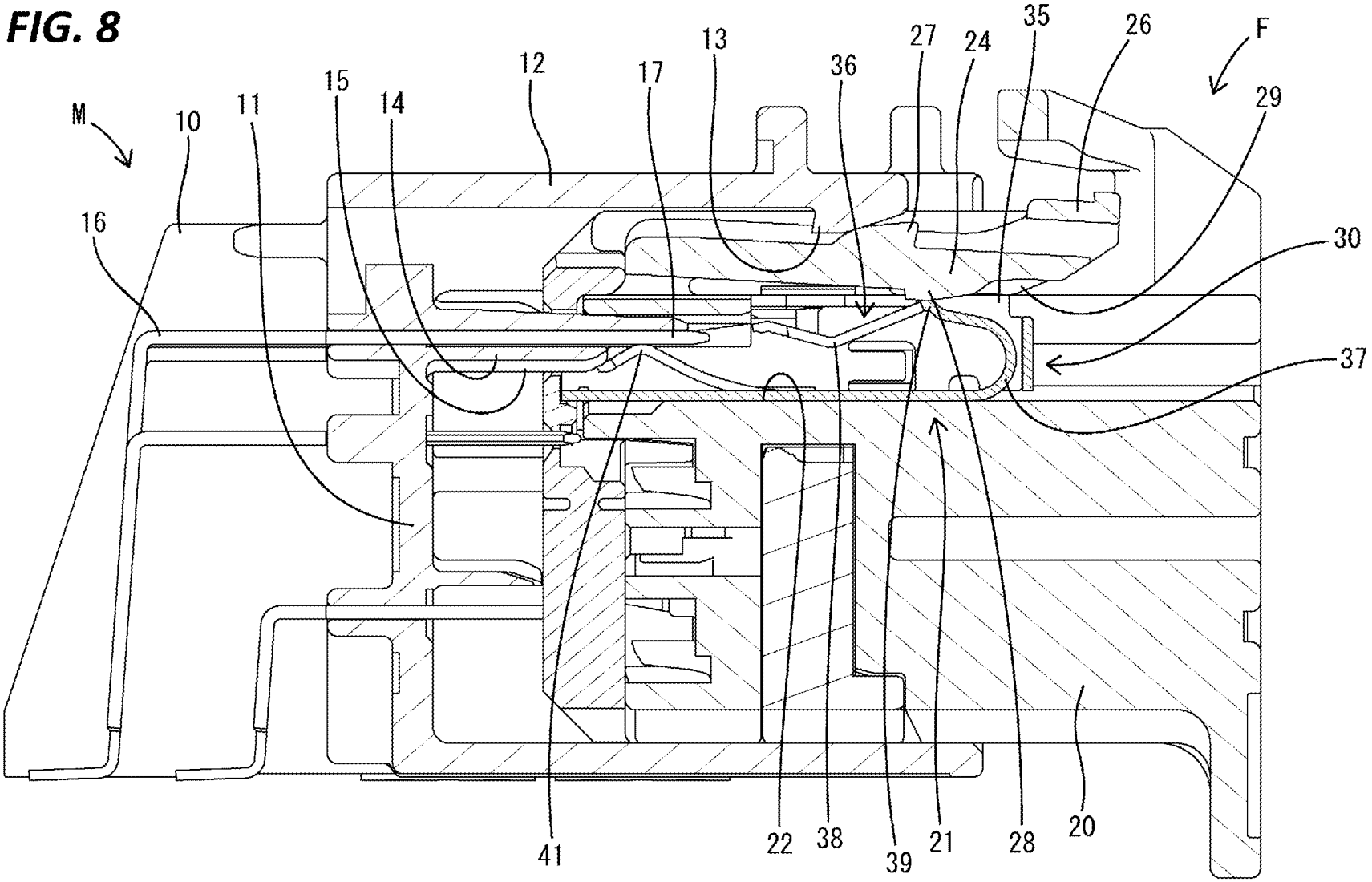
FIG. 8 is a section along X-X of FIG. 1 showing a state where the inclination of the shorting terminal fitting is detected in a connection process of the female connector and the male connector.

Note that, in the following description, a left side in FIGS. 6 to 8 is defined as a front side concerning a front-rear direction of the female connector F, and a right side in FIGS. 6 to 8 is defined as a front side concerning a front-rear direction of the male connector M. Upper and lower sides shown in FIGS. 1 to 9 are directly defined as upper and lower sides concerning a vertical direction. Left and right sides shown in FIGS. 1 to 4 and 9 are directly defined as left and right sides concerning a lateral direction.

<Male Connector M>

As shown in FIGS. 6 to 8, the male connector M includes a male housing 10 (mating housing as claimed) made of synthetic resin and a pair of detection terminals 16 provided in the male housing 10. The male housing 10 includes a wall-like terminal holding portion 11 and a receptacle 12 in the form of a rectangular tube projecting forward of the male housing 10 from the outer peripheral edge of the terminal holding portion 11. A projection-like lock portion 13 is formed on the lower surface of an upper wall portion constituting the receptacle 12.

Figure 9:
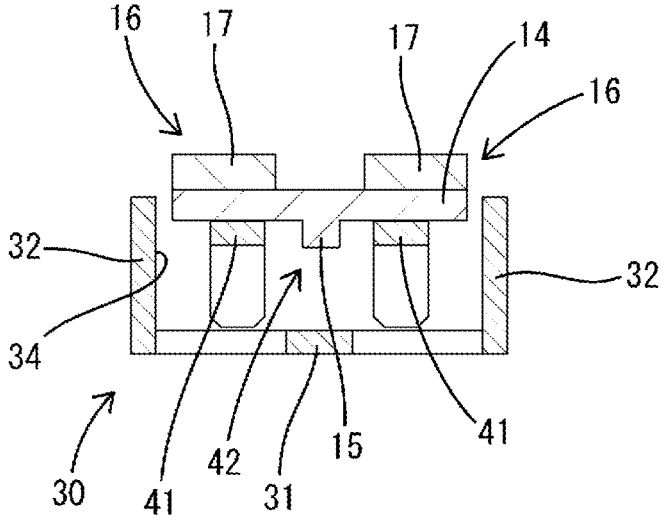
FIG. 9 is a back view in section showing a contact state of wiping springs of the shorting terminal fitting and a short-circuit releasing portion of the male connector.

The terminal holding portion 11 is formed with a short-circuit releasing portion 14 cantilevered forward (same direction as a connecting direction of the male connector M to the female connector F) from a front surface. The short-circuit releasing portion 14 is made of synthetic resin and, as shown in FIG. 9, in the form of a flat plate whose plate thickness direction is aligned with the vertical direction (direction orthogonal to the connecting direction of the both housings 10, 20). The short-circuit releasing portion 14 is integrally formed with a reinforcing rib 15 for enhancing the rigidity of the short-circuit releasing portion 14. The reinforcing rib 15 projects downward (in the plate thickness direction of the short-circuit releasing portion 14) from a laterally central part of the lower surface of the short-circuit releasing portion 14. The reinforcing rib 15 extends along a length direction (direction parallel to the connecting/separating direction of the both connectors F, M) of the short-circuit releasing portion 14.

The pair of detection terminals 16 are mounted into the male housing 10 through the terminal holding portion 11. Out of the pair of detection terminals 16, detection connecting portions 17 surrounded by the receptacle 12 are cantilevered forward similarly to the short-circuit releasing portion 14. A pair of the detection connecting portions 17 are disposed in parallel while being spaced apart in the lateral direction (direction orthogonal to the connecting direction of the both housings 10, 20). The upper surface of the short-circuit releasing portion 14 is held in close surface contact with the lower surfaces of the pair of detection connecting portions 17. Front end parts (projecting end parts) of the pair of detection connecting portions 17 project further forward than the front ends of the short-circuit releasing portion 14 and the reinforcing rib 15. With the both housings 10, 20 properly connected, the lower surfaces of the front end parts of the pair of detection connecting portions 17 are in contact with a shorting terminal fitting 30 to be described later, and the pair of detection terminals 16 are shorted via the shorting terminal fitting 30.

<Female Connector F>

The female connector F includes a female housing 20 (connector housing as claimed) made of synthetic resin and one shorting terminal fitting 30. A terminal mounting portion 21 for mounting the shorting terminal fitting 30 is formed in an upper end part of the female housing 20. The terminal mounting portion 21 includes a groove-like accommodation recess 22 open in the upper surface (outer surface) and both front and rear surfaces of the female housing 20. The shorting terminal fitting 30 is accommodated in the accommodation recess 22. A pair of left and right press-fitting portions (not shown) are formed on front end parts of both left and right inner side surfaces of the accommodation recess 22. A pair of left and right groove portions 23 extending in the front-rear direction are formed in the both left and right inner side surfaces of the accommodation recess 22.

The female housing 20 is integrally formed with a lock arm 24 disposed to face the upper surface thereof (terminal mounting portion 21). The lock arm 24 is supported on the upper surface of the female housing 20 at a leg portion 25 on a front end part, and is held in a locking posture to be parallel to the upper surface of the female housing 20 and the connecting direction of the both housings 10, 20. The lock arm 24 is resiliently displaceable in an unlocking direction (direction toward the terminal mounting portion 21) with the leg portion 25 as a fulcrum. A resilient displacement direction of the lock arm 24 is a direction substantially orthogonal to the connecting/separating direction of the both connectors F, M.

An unlocking portion 26 for pressing the lock arm 24 in the unlocking direction is formed on an rear end part of the upper surface of the lock arm 24. A lock projection 27 is formed at a position forward of the unlocking portion 26 on the upper surface of the lock arm 24. The lower surface (surface opposite to the unlocking portion 26 and the lock projection 27 in the resilient displacement direction of the lock arm 24) of the lock arm 24 is facing an opening in the upper surface of the accommodation recess 22.

A projection-like pressing portion 28 is formed on the lower surface of the lock arm 24. The pressing portion 28 is disposed in a central part of the lock arm 24 in the lateral direction (direction orthogonal to both the connecting direction of the both housings 10, 20 and the resilient displacement direction of the lock arm 24). The pressing portion 28 is disposed at a position slightly forward of the rear end of the lock arm 24 in the front-rear direction.

A pair of bilaterally symmetrical assembly detecting portions 29 projecting downward (connection releasing direction) are formed on the lower surface of the lock arm 24. The pair of assembly detecting portions 29 are disposed at an interval in the lateral direction and located on both left and right end parts of the lock arm 24. The pair of assembly detecting portions 29 are disposed at positions behind and adjacent to the pressing portion 28 in the front-rear direction. When the lock arm 24 is in an initial state (state where the lock arm 24 is not resiliently displaced), the lowest ends of the assembly detecting portions 29 are located above that of the pressing portion 28.

Figure 2:
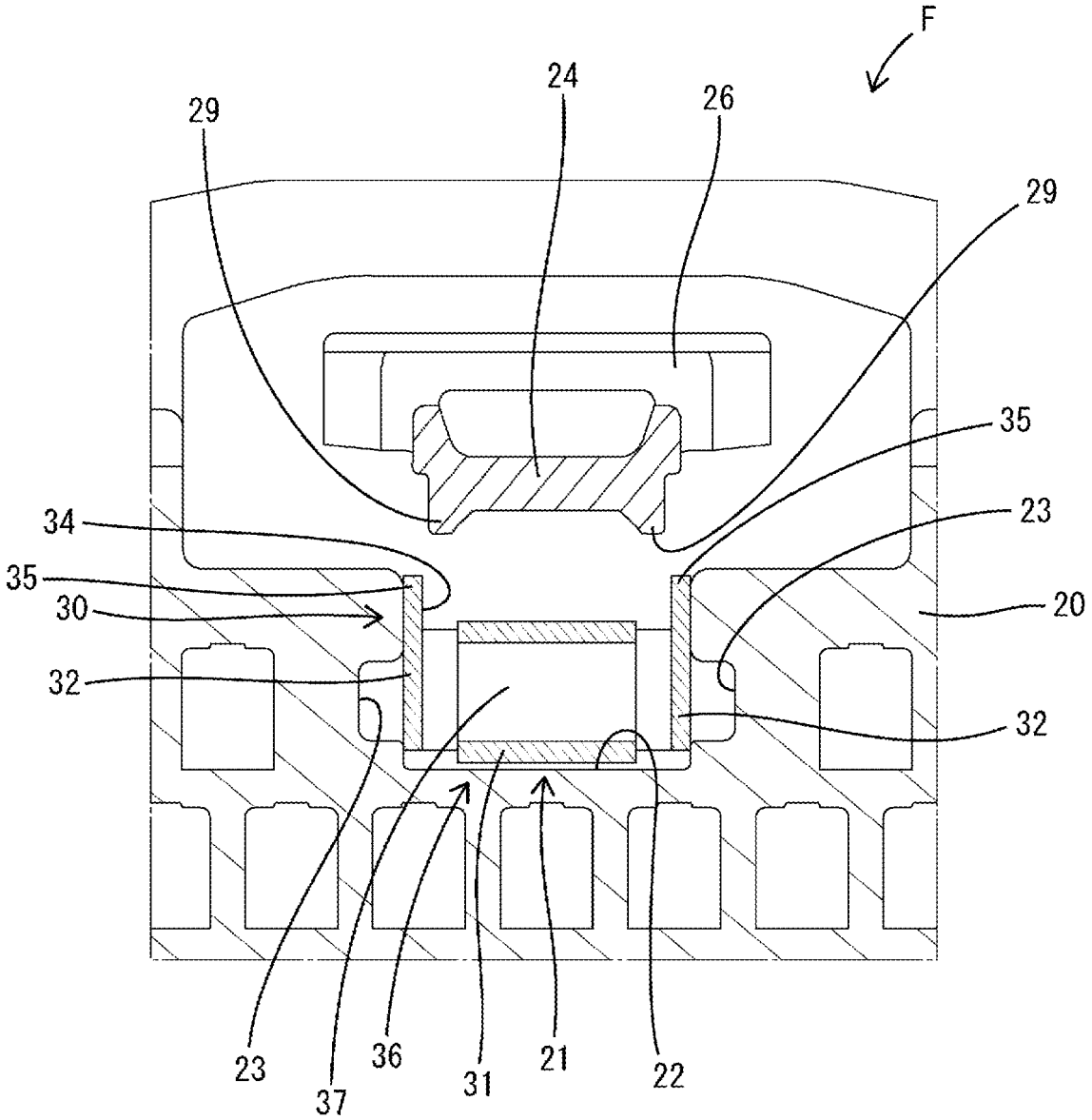
FIG. 2 is a front view in section showing the state where the lock arm is not resiliently deflected.
Figure 3:
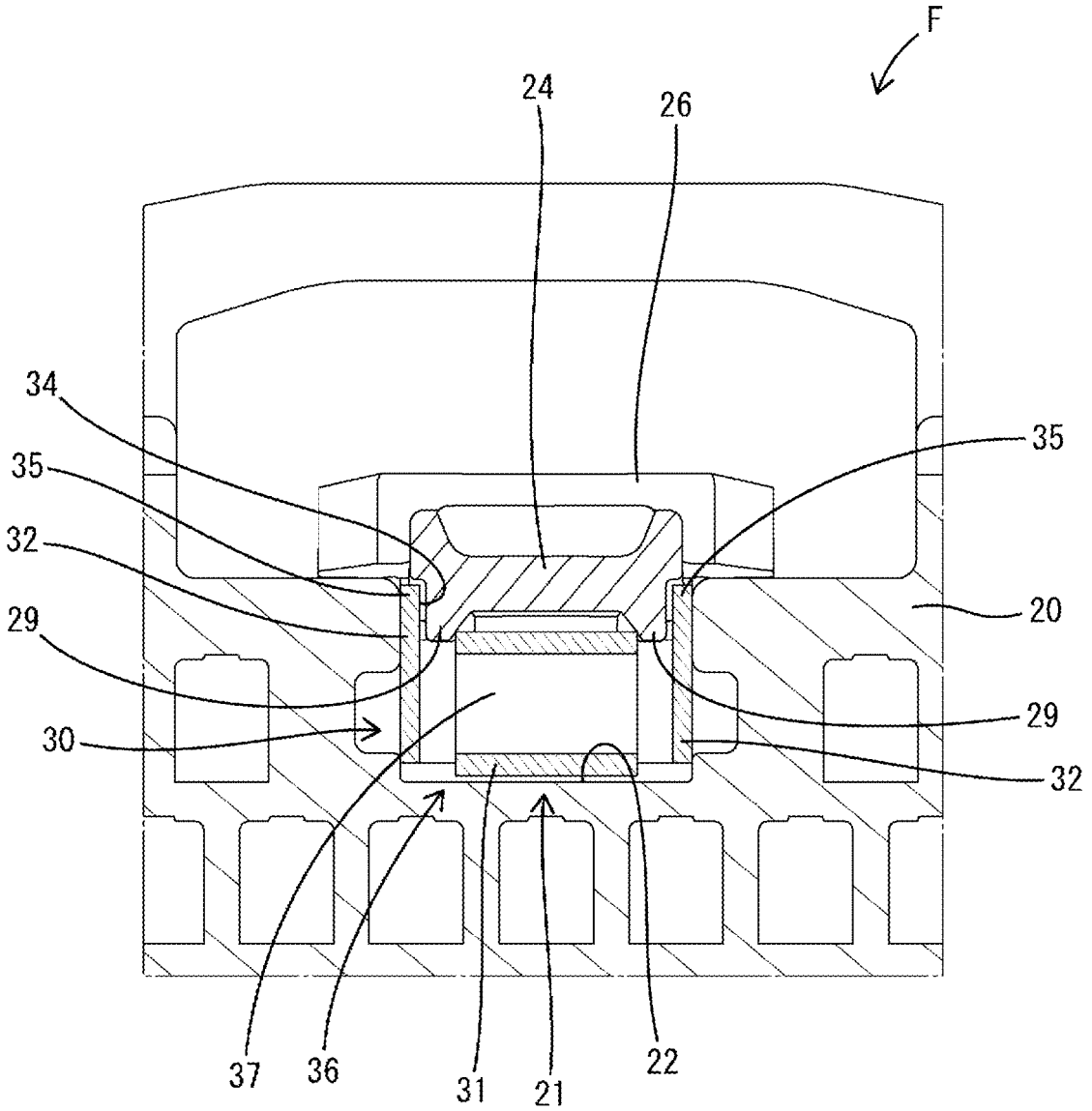
FIG. 3 is a front view in section showing a state where the lock arm is resiliently deflected.

The left side surface of the left assembly detecting portion 29 is a flat surface parallel to the resilient displacement direction of the lock arm 24 and continuous and flush with the left outer side surface of the lock arm 24. The right side surface of the left assembly detecting portion 29 is a flat surface inclined with respect to the resilient displacement direction of the lock arm 24. As shown in FIGS. 2 to 4, the left assembly detecting portion 29 has a trapezoidal shape with unequal sides whose width (lateral dimension) is gradually reduced from a base end side (upper end side) toward a projecting end side (lower end side) in a projecting direction in a front view.

The right side surface of the right assembly detecting portion 29 is a flat surface parallel to the resilient displacement direction of the lock arm 24 and continuous and flush with the right outer side surface of the lock arm 24. The left side surface of the right assembly detecting portion 29 is a flat surface inclined with respect to the resilient displacement direction of the lock arm 24. As shown in FIGS. 2 to 4, the right assembly detecting portion 29 has a trapezoidal shape with unequal sides whose width (lateral dimension) is gradually reduced from a base end side (upper end side) toward a projecting end side (lower end side) in a projecting direction in a front view.

The shorting terminal fitting 30 is a single component formed by applying bending and the like to a metal plate material stamped into a predetermined shape. As shown in FIG. 5, the shorting terminal fitting 30 includes a base plate portion 31, a pair of bilaterally symmetrical protection wall portions 32, a rear wall portion 33, a shorting spring 36 and a pair of bilaterally symmetrical wiping springs 41. With the shorting terminal fitting 30 properly mounted in the terminal mounting portion 21 (accommodation recess 22), the base plate portion 31 is assembled in surface contact with the inner bottom surface of the accommodation recess 22.

The pair of left and right protection wall portions 32 extend upward substantially at a right angle from both left and right side edges of the base plate portion 31, and are formed from the front end to the rear end of the base plate portion 31. The rear wall portion 33 is cantilevered substantially at a right angle from the rear end edge of either one of the left and right protection wall portions 32 to the rear end edge of the other protection wall portion 32. A space defined by the base plate portion 31, the both left and right protection wall portions 32 and the rear wall portion 33 serves as a spring accommodation space 34. The spring accommodation space 34 constitutes an internal space of the shorting terminal fitting 30 and is open forward and upward of the shorting terminal fitting 30.

The both left and right protection wall portions 32 are formed with a pair of left and right detection contact portions 35. The pair of detection contact portions 35 are disposed on rear end parts of upper edge parts (edge parts facing the lower surface of the lock arm 24 in the resilient displacement direction of the lock arm 24) of the both left and right protection wall portions 32. In the front-rear direction, the detection contact portions 35 are disposed substantially at the same position as the assembly detecting portions 29 of the lock arm 24. In a state where the lock arm 24 is not resiliently displaced, the assembly detecting portions 29 are located above the detection contact portions 35. A lateral interval (interval between the inner side surfaces of the pair of protection wall portions 32) of the pair of detection contact portions 35 is set equal to or slightly larger than a distance between the outer side surfaces of the pair of assembly detecting portions 29.

The shorting spring 36 is composed of one folded portion 37 and a pair of bilaterally symmetrical resilient contact pieces 38, and accommodated in the spring accommodation space 34. The folded portion 37 is in the form of a curved plate extending upward from the rear end edge of the base plate portion 31 and having a semicircular shape in a side view. A pressure receiving portion 39 constituting an uppermost part of the shorting spring 36 is formed on an extending end edge part of the folded portion 37. The pair of resilient contact pieces 38 are cantilevered obliquely to a lower-front side from the pressure receiving portion 39. The resilient contact pieces 38 have such a valley shape bent at an obtuse angle in a side view that a central part in the front-rear direction is lowest. Extending end parts (front end parts) of the resilient contact pieces 38 serve as contact point portions 40 to be brought into contact with the detection terminals 16.

The pressure receiving portion 39 is disposed substantially at the same position as the pressing portion 28 of the lock arm 24 in the front-rear direction and also disposed substantially at the same position as the pressing portion 28 in the lateral direction. In the state where the lock arm 24 is not resiliently displaced, the pressing portion 28 is located above the pressure receiving portion 39. In the state where the lock arm 24 is not resiliently displaced, a vertical interval between the pressing portion 28 and the pressure receiving portion 39 (shorting spring 36) is set smaller than that between the assembly detecting portions 29 and the folded portion 37 (shorting spring 36).

The pair of wiping springs 41 are formed by cutting and raising plate parts of the base plate portion 31 upwardly and accommodated in the spring accommodation space 34. The wiping spring 41 is cantilevered obliquely to an upper-front side from a central part of the base plate portion 31 in the front-rear direction and disposed forward of the shorting spring 36. The pair of wiping springs 41 are disposed in parallel with a clearance 42 defined therebetween.

Press-fitting blades 43 having a sawtooth shape in a side view are respectively formed on front end parts of the upper edge parts of the both left and right protection wall portions 32. The shorting terminal fitting 30 is assembled into the terminal mounting portion 21 by being inserted into the accommodation recess 22 from behind the female housing 20. In a final stage of an assembly process, a pair of left and right press-fitting blades 43 are press-fit to bite into the pair of left and right press-fitting portions of the accommodation recess 22 and the shorting terminal fitting 30 is fixed in the accommodation recess 22. Further, with the shorting terminal fitting 30 mounted in the accommodation recess 22, locking pieces 44 formed in the protection wall portions 32 are fit into the groove portions 23 in the inner side surfaces of the accommodation recess 22, thereby restricting improper assembling, i.e. large lateral inclination, of the shorting terminal fitting 30.

If the shorting terminal fitting 30 is mounted in a proper posture in the terminal mounting portion 21, the pair of assembly detecting portions 29 are located in a region (spring accommodation space 34) between the pair of protection wall portions 32 in the lateral direction. In contrast, if the shorting terminal fitting 30 is mounted in an improper posture, for example, inclined to left or right in the terminal mounting portion 21, there is a height difference between the pair of protection wall portions 32 and the detection contact portion 35 formed on the higher protection wall portion 32 is displaced laterally inward and located to be able to interfere with the assembly detecting portion 29.

Next, a connection process of the female connector F (female housing 20) and the male connector M (male housing 10) when the shorting terminal fitting 30 is mounted in the proper posture in the terminal mounting portion 21 is described. When the female housing 20 is fit into the receptacle 12, the lower surfaces of the detection connecting portions 17 of the detection terminals 16 slide in contact with the wiping springs 41 to remove foreign matters adhering to the detection connecting portions 17. Since the lock projection 27 of the lock arm 24 and the lock portion 13 of the receptacle 12 come into contact with each other while the detection connecting portions 17 are sliding on the wiping springs 41, the lock arm 24 is resiliently displaced downward (in the unlocking direction toward the terminal mounting portion 21). As the lock arm 24 is resiliently displaced, the pressing portion 28 presses the pressure receiving portion 39 of the shorting terminal fitting 30 downward, wherefore the shorting spring 36 is resiliently deformed. At this time, the pressing portion 28 presses a laterally central part of the pressure receiving portion 39 (shorting spring 36).

When the lock projection 27 is located right below the lock portion 13 and the lock arm 24 is maximally resiliently displaced as shown in FIG. 7, the both connectors F, M (both housings 10, 20) are incompletely connected before reaching a properly connected state. In the incompletely connected state, the contact point portions 40 of the shorting spring 36 are retracted to lower positions so as not to interfere with the detection connecting portions 17. Further, front end parts of the detection connecting portions 17 move to positions above the contact point portions 40 and the short-circuit releasing portion 14 enters between the wiping springs 41 and the detection connecting portions 17, whereby a short circuit between the pair of detection terminals 16 is released. Further, as shown in FIG. 3, the pair of assembly detecting portions 29 are displaced downward along the inner side surfaces of the pair of protection wall portions 32 and are accommodated into the spring accommodation space 34.

When the both connectors F, M reach the properly connected state, the lock arm 24 resiliently returns upward as shown in FIG. 8. Thus, the pressure receiving portion 39 is released from the pressing of the pressing portion 28 and the shorting spring 36 resiliently returns. As the shorting spring 36 resiliently returns, the pair of contact point portions 40 are displaced upward and resiliently contact the lower surfaces of the pair of detection terminals 16 (detection connecting portions 17). Thus, the pair of detection terminals 16 are shorted. Therefore, whether or not the both connectors F, M are in the properly connected state can be detected based on whether or not the pair of detection terminals 16 are shorted.

If the shorting terminal fitting 30 is mounted in an improper posture, for example, inclined to left or right with respect to the terminal mounting portion 21 and there is a height difference between the both left and right protection wall portions 32, the female connector F and the male connector M cannot be properly connected. Specifically, in a state where the shorting terminal fitting 30 is inclined leftward and the right protection wall portion 32 is higher than the left protection wall portion 32 as shown in FIG. 4, the right assembly detecting portion 29 interferes to contact the right detection contact portion 35 from above before the lock arm 24 is maximally resiliently displaced if the lock arm 24 is resiliently displaced in the connection process of the both connectors F, M.

In order for the both connectors F, M to reach the properly connected state, the connectors F, M need to go through the incompletely connected state. However, since a resilient displacement of lock arm 24 is restricted by the interference of the assembly detecting portion 29 with the detection contact portion 35 as shown in FIG. 8, the lock projection 27 and the lock portion 13 are left to interfere with each other in the front-rear direction and the both connectors F, M cannot reach the properly connected state.

In a state before the both connectors F, M reach the incompletely connected state, the detection connecting portions 17 are in contact with the wiping springs 41. Thus, the pair of detection terminals 16 are shorted as in the properly connected state. However, since the female housing 20 largely projects outwardly of the receptacle 12, it can be visually confirmed that the both connectors F, M have not reached the properly connected state. By making it impossible to proceed with the connecting operation of the both connectors F, M before the properly connected state is reached in this way, the oblique mounting of the shorting terminal fitting 30 can be detected.

As described above, the female connector F constituting the connector device of this embodiment is connectable to the male housing 10 and includes the female housing 20 reaching the properly connected state by way of the incompletely connected state in the connection process and the shorting terminal fitting 30. The female housing 20 is formed with the terminal mounting portion 21, and the shorting terminal fitting 30 is mounted in the terminal mounting portion 21. The female housing 20 is formed with the lock arm 24 resiliently displaceable toward the terminal mounting portion 21 due to interference with the male housing 10 in the incompletely connected state. The lock arm 24 is formed with the assembly detecting portions 29.

If the shorting terminal fitting 30 is mounted in an improper posture laterally inclined in the terminal mounting portion 21, the assembly detecting portion 29 interferes with the protection wall portion 32 of the shorting terminal fitting 30 in the connection process of the female housing 20 and the male housing 10, whereby an improperly assembled state of the shorting terminal fitting 30 can be detected. Specifically, any further resilient displacement of the lock arm 24 is restricted by the interference of the assembly detecting portion 29 and the protection wall portion 32 of the shorting terminal fitting 30. Therefore, whether or not the shorting terminal fitting 30 is properly mounted can be detected based on whether or not the lock arm 24 can be properly resiliently displaced in the connection process of the male housing 10 and the female housing 20.

Further, the shorting terminal fitting 30 includes the shorting spring 36 and the pair of protection wall portions 32 disposed to laterally face each other across the shorting spring 36. If the shorting terminal fitting 30 is mounted in the proper posture, the assembly detecting portions 29 are displaced along the inner surfaces of the protection wall portions 32 as the lock arm 24 is resiliently displaced. In contrast, if the shorting terminal fitting 30 is inclined and improperly assembled, the assembly detecting portion 29 interferes with the detection contact portion 35 on the upper end of the protection wall portion 32, thereby restricting a resilient displacement of the lock arm 24. According to this configuration, the spring accommodation space 34 between the pair of protection wall portions 32, i.e. the internal space of the shorting terminal fitting 30, is effectively utilized as a space for displacing the assembly detecting portions 29 when the lock arm 24 is resiliently displaced. Therefore, the female housing 20 can be reduced in size as compared to the case where displacement spaces for the assembly detecting portions 29 are secured outside the shorting terminal fitting 30.

Further, the shorting spring 36 shorts the pair of detection terminals 16 by resiliently contacting the pair of detection terminals 16 provided in the male housing 10 in the properly connected state. The lock arm 24 includes the pressing portion 28 capable of contacting the shorting spring 36. When the both connectors F, M are in the incompletely connected state, the pressing portion 28 presses the shorting spring 36 to a short-circuit releasing position where the shorting spring 36 cannot contact the pair of detection terminals 16. When the both connectors F, M reaches the properly connected state, the pressing portion 28 resiliently returns to a lock position and is separated from the shorting spring 36.

Since this pressing portion 28 presses the central part of the shorting spring 36 in a facing direction (lateral direction) of the pair of protection wall portions 32, the shorting spring 36 is not laterally inclined when being resiliently deformed by receiving a pressing force of the pressing portion 28. Since the shorting spring 36 is not laterally inclined, the lock arm 24 receiving a resilient reaction force of the shorting spring 36 is also not laterally inclined. Therefore, it is possible to avoid a situation where either one of the left and right assembly detecting portions 29 interferes with the detection contact portion 35 due to the leftward or rightward inclination of the lock arm 24 although the shorting terminal fitting 30 is mounted in the proper posture without being laterally inclined. In this way, it is possible to avoid erroneous detection of the connected state due to the inclination of the lock arm 24 pressed by the shorting spring 36.

Further, in the state where the lock arm 24 is not resiliently displaced, the interval in the vertical direction (resilient displacement direction of the lock arm 24) between the assembly detecting portions 29 and the shorting spring 36 is set larger than that in the vertical direction between the pressing portion 28 and the shorting spring 36. Due to this dimensioning, the pressing portion 28 comes into contact with the shorting spring 36 earlier than the assembly detecting portions 29 to resiliently deform the shorting spring 36 downward when the lock arm 24 is resiliently displaced. Therefore, there is no concern that the assembly detecting portions 29 interfere with the shorting spring 36.

Further, the shorting terminal fitting 30 is formed with the pair of left and right wiping springs 41 arranged in parallel across the clearance 42. The pair of detection terminals 16 slide in contact with the pair of wiping springs 41 in the connection process of the male housing 10 and the female housing 20, and the pair of wiping springs 41 are separated from the pair of detection terminals 16 by the flat plate-like short-circuit releasing portion 14 formed in the male housing 10 in the properly connected state. The clearance 42 serves as an entrance path for the reinforcing rib 15 projecting in the plate thickness direction of the short-circuit releasing portion 14 from the short-circuit releasing portion 14. According to this configuration, the rigidity of the short-circuit releasing portion 14 can be enhanced, utilizing the clearance 42 provided between the pair of wiping springs 41.

Further, the assembly detecting portions 29 may be in the form of projections and widened from the base end (upper end) sides toward the projecting end (lower end) sides in the projecting direction. According to this configuration, projecting dimensions of the assembly detecting portions 29 can be secured without reducing the strength of the assembly detecting portions 29.

Other Embodiments

The present invention is not limited to the above described and illustrated embodiment. For example, the following embodiments are also included in the technical scope of the present invention.

(1) Although the spaces into which the assembly detecting portions are accommodated when the lock arm is resiliently displaced are secured in the spring accommodation space (internal space of the shorting terminal fitting) between the pair of protection wall portions in the above embodiment, accommodation spaces for the assembly detecting portions may be secured outside the shorting terminal fitting.

(2) Although the pair of assembly detecting portions are disposed while being laterally spaced apart in the above embodiment, one assembly detecting portion may be provided in a laterally central part.

(3) Although the assembly detecting portion is widened from the projecting end side toward the base end side in the projecting direction in the above embodiment, an assembly detecting portion may have a constant width from the base end side to the projecting end in the projecting direction.

(4) Although the interval between the assembly detecting portions and the shorting spring is set larger than that between the pressing portion and the shorting spring in the state where the lock arm is not resiliently displaced in the above embodiment, the interval between the assembly detecting portions and the shorting spring may be set smaller than or equal to that between the pressing portion and the shorting spring.

(5) Although the connector of the type that the detection terminals provided in the mating housing are shorted by the shorting terminal fitting when the mating housing and the connector housing are properly connected in the above embodiment, the present invention can also be applied to a connector housing of a type that detection terminals provided in the connector housing are shorted by a shorting terminal fitting in a state where a mating housing and the connector housing are not connected yet.

(6) Although the shorting terminal fitting is improperly assembled to be laterally inclined in the above embodiment, the present invention can be applied also when a shorting terminal fitting is improperly assembled to be inclined in a direction other than the lateral direction.

LIST OF REFERENCE NUMERALS

F . . . female connector (connector)
10 . . . male housing (mating housing)
14 . . . short-circuit releasing portion
15 . . . reinforcing rib
16 . . . detection terminal
20 . . . female housing (connector housing)
21 . . . terminal mounting portion
24 . . . lock arm
28 . . . pressing portion
29 . . . assembly detecting portion
30 . . . shorting terminal fitting
32 . . . protection wall portion
36 . . . shorting spring
41 . . . wiping spring
42 . . . clearance

What is claimed is:

1. A connector, comprising:

a connector housing connectable to a mating housing, the connector housing reaching a properly connected state by way of an incompletely connected state in a connection process;

a terminal mounting portion formed in the connector housing;

a shorting terminal fitting mounted in the terminal mounting portion;

a lock arm formed in the connector housing, the lock arm being resiliently displaceable toward the terminal mounting portion due to interference with the mating housing in the incompletely connected state; and an assembly detecting portion formed on the lock arm, the assembly detecting portion being capable of detecting an improperly assembled state of the shorting terminal fitting by interfering with the shorting terminal fitting in the connection process of the connector housing and the mating housing when the shorting terminal fitting is mounted in an improper posture in the terminal mounting portion, wherein the assembly detecting portion includes a pair of assembly detecting portions that are disposed on both left and right end parts of a lower surface of the lock arm with a predetermined interval between the pair of assembly detecting portions, the shorting terminal fitting includes a shorting spring and a pair of protection wall portions disposed to face each other across the shorting spring, the assembly detecting portion is displaced along inner surfaces of the protection wall portions as the lock arm is resiliently displaced if the shorting terminal fitting is mounted in a proper posture, a resilient displacement of the lock arm is restricted due to the interference of the assembly detecting portion with the protection wall portion if the shorting terminal fitting is improperly assembled, the shorting spring resiliently contacts a pair of detection terminals provided in the mating housing in the properly connected state, thereby shorting the pair of detection terminals, the lock arm includes a pressing portion for pressing the shorting spring to a short-circuit releasing position where the shorting spring is incapable of contacting the pair of detection terminals in the incompletely connected state and resiliently returning to a lock position to be separated from the shorting spring in the properly connected state, the pressing portion presses a central part of the shorting spring in a facing direction of the pair of protection wall portions, the shorting terminal fitting is formed with a pair of wiping springs arranged in parallel across a clearance, the pair of detection terminals sliding in contact with the pair of wiping springs in the connection process of the mating housing and the connector housing, the pair of wiping springs being separated from the detection terminals by a flat plate-like short-circuit releasing portion formed in the mating housing in the properly connected state, and the clearance serves as an entrance path for a reinforcing rib projecting in a plate thickness direction of the short-circuit releasing portion from the short-circuit releasing portion.

2. The connector of claim 1, wherein an interval between the assembly detecting portion and the shorting spring is set larger than an interval between the pressing portion and the shorting spring in a state where the lock arm is not resiliently displaced.

3. The connector of claim 1, wherein the pair of assembly detecting portions are disposed at positions behind and adjacent to the pressing portion in a front-rear direction of the lock arm.

* * * * *